United States Patent [19]

Okada et al.

[11] 3,975,484

[45] Aug. 17, 1976

[54] MANUFACTURE OF CRIMPED POLYAMIDE FILAMENTS YARN

[75] Inventors: Reisuke Okada, Okazaki; Hiroshi Okuno, Aichi; Toshio Fukama, Okazaki, all of Japan

[73] Assignee: Toray Industries, Inc., Tokyo, Japan

[22] Filed: Feb. 24, 1975

[21] Appl. No.: 552,417

[30] Foreign Application Priority Data

Feb. 26, 1974 Japan ..... 49-21915

[52] U.S. Cl. ..... 264/168; 28/1.3; 28/72.11; 28/72.17; 264/177 F; 264/210 F; 264/290 N

[51] Int. Cl.[2] ..... D01D 5/22; D01D 5/12

[58] Field of Search ..... 264/168, 177 F, 210 F, 264/290 N; 28/1.3, 72.11, 72.17

[56] References Cited

FOREIGN PATENTS OR APPLICATIONS

| | | | |
|---|---|---|---|
| 45-12546 | 5/1970 | Japan | 264/168 |
| 45-35808 | 11/1970 | Japan | 264/168 |
| 45-36336 | 11/1970 | Japan | 264/162 |
| 47-48286 | 12/1972 | Japan | 264/290 |

*Primary Examiner*—Jay H. Woo

[57] ABSTRACT

A method for the manufacture of crimped polyamide filament yarns. Polyamide filaments having non-circular cross sections are melt-spun, allowed to cool, and treated with a substantially non-aqueous oiling agent. They are passed around a feed roll, are passed in contact with a heated body having a curved surface and thus subjected to one-sided heating and then to drawing, are passed around a heated draw roll, and then are passed through a steam jet.

20 Claims, 1 Drawing Figure

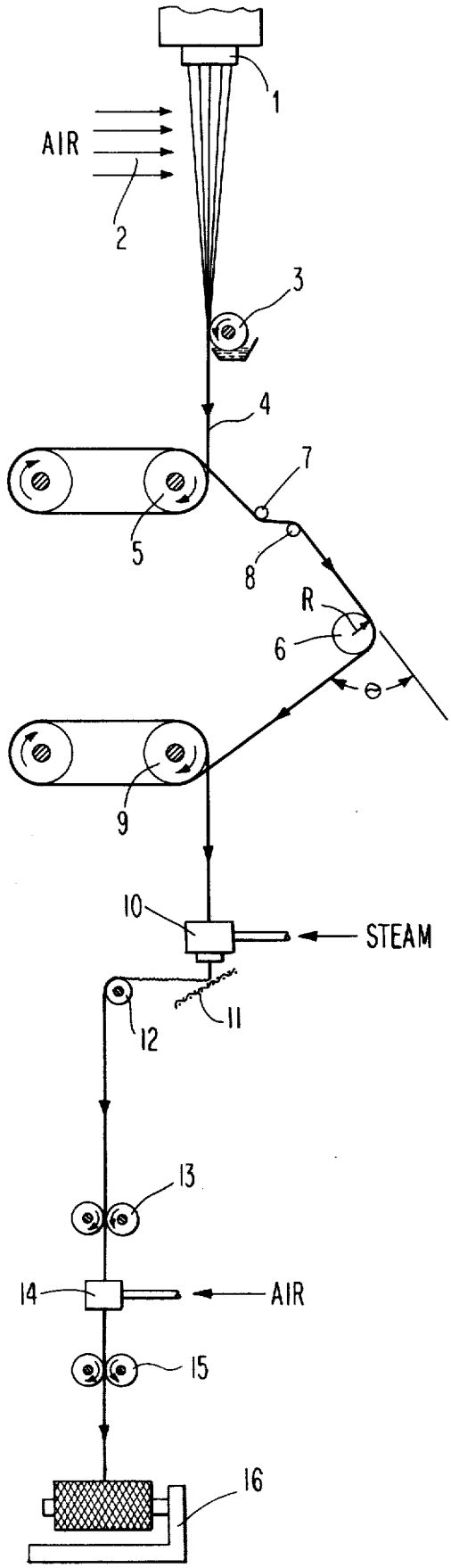
1
AIR
2
3
4
7
5
8
R
6
θ
9
10
STEAM
11
12
13
14
AIR
15
16

MANUFACTURE OF CRIMPED POLYAMIDE FILAMENTS YARN

BACKGROUND OF THE INVENTION

This invention relates to the manufacture of crimped polyamide filaments having excellent properties for use as rugs and carpets. More particularly, the invention relates to an improved method which imparts a stable crimp to polyamide filaments and which affords much higher operating speeds in processing the yarn.

Steam jet crimping processes are disclosed in Scott U.S. Pat. No. 3,143,784, Breen et al., U.S. Pat. Nos. 3,186,155, 3,421,194 and 3,543,358, Weiss U.S. Pat. No. 3,255,508 and Richmond et al., U.S. Pat. No. 3,380,242.

The Breen et al., U.S. Pat. No. 3,543,358 teaches that preferred speeds for feeding yarn to a steam jet are in the range of 100 to 800 yards per minute (90 to 720 meters per minute).

This invention provides a steam jet crimping process having feed yarn speeds which are higher than 800 meters per minute.

Such a high operating speed is accomplished in this invention by adopting particular conditions prior to steam jet crimping in a continuous process. Such particular conditions include melt spinning a non-circular cross section polyamide filament yarn, treating the yarn with a substantially non-aqueous oiling agent, applying one-sided heating and drawing steps substantially simultaneously, to the oil finished yarn while the yarn is passing over a heated body having a curved surface and, after that, applying heat treatment to the one-sided heated and drawn yarn. The heat treated yarn is then fed to a steam jet with speeds that are higher than 800 meters per minute, and are there subjected to steam jet crimping.

SUMMARY OF THE INVENTION

This invention provides a process for the production of crimped filaments of polyamide.

The process in accordance with the invention comprises providing polyamide filaments having non-circular cross sections, which are melt-spun from a spinneret, allowed to cool, treated with a substantially non-aqueous oil agent, passed around a feed roll having a peripheral speed of more than about 200 meters per minute, passed in contact with a heated body through a contact angle between about 80° and about 160°with the surface temperature of the heated body maintained in the range of about 170°–250°C and with the radius of surface curvature in the range of about 15–75 millimeters. The filaments are there subjected to one-sided heating and drawing, passed around a heated draw roll having a peripheral speed of more than about 800 meters per minute and a surface temperature of less than about 220°C, and then passed through a steam jet which is supplied with steam at a temperature in the range of about 200°–350°C.

The polyamide in accordance with this invention may consist of any of the synthetic linear polyamide compositions conventionally used in textile filaments and yarns. Preferably, the polyamide is selected from the group consisting of poly-epsilon-capramide and polyhexamethylene adipamide. Where poly-epsilon-capramide is used, it is preferred to use one having a relative viscosity between about 2.0 and about 3.0, which is determined by measuring the flow time of the solution of 1.0 weight percent of the flakes of poly-epsilon-capramide, dissolved in 25 CC of 98% sulfuric acid, using an Ostwald viscometer at 25°C.

In connection with the melt spinning of the non-circular cross section polyamide filaments used in this invention, reference may be made to the process and apparatus shown in various patents including Pamm et al., U.S. Pat. No. 2,816,349, Holland U.S. Pat. Nos. 2,939,201 and 2,939,202, Lehmicke U.S. Pat. No. 2,945,739, McKinney U.S. Pat. No. 3,109,220, Ellingsen U.S. Pat. No. 3,109,768, Pitel et al., U.S. Pat. Nos. 3,164,949 and 3,220,173, Opfell et al., U.S. Pat. Nos. 3,216,186 and 3,308,221, and Dradley et al., U.S. Pat. No. 3,478,389.

In this invention, the substantially non-aqueous oiling agent is an oiling agent (spin finish) having a water content in the range of about 0–5 weight percent. Any of the oiling agents conventionally used in polyamide spinning process may be used in accordance with this invention, by adjusting the water content to the range of about 0–5 weight percent. The preferred oil itself consists of about 15–25 percent of lauryl alcohol with added ethylene oxide and about 75–85 percent of mineral oil. This oil content may be used as the substantially non-aqueous oiling agent by itself, or by adding water to adjust the water content to the range of over zero to 5 weight percent. The more preferred water content of the oiling agent is in the range of 0–1.5 weight percent.

The volume of the oiling agent picked up by the filaments should be not less than about 1.0 weight percent of the weight of the filaments, more preferably not less than about 3.0 weight percent.

It is preferred that the denier of each single filament in the bundle of the filaments being introduced into the heated body in accordance with this invention should be in the range of from about 25 to about 120 denier.

With respect to the specific forms of non-circular cross sections of filaments used in this invention, Y shape, + shape and T shape filament cross sections are preferable. In this case, the modification ratio of the radius of a circumscribed circle to an inscribed circle should be between about 1.5 and about 5.0, and more preferably between about 2.0 and about 3.0. The term "modification ratio" is suitably defined in Holland U.S. Pat. Nos. 2,939,201 and 2,939,202. Other figures of non-circular cross section, for example, triangular shapes, rectangular shapes, dumb-bell shapes, dog-bone shapes, etc. are also applicable in accordance with this invention.

It is preferable that the surfaces of the feed roll and the draw roll should be finished with aventurine.

Referring now to the peripheral speed of the feed rolls in this invention, this must be maintained higher than about 200 meters per minute. Values between about 200 and 400 meters per minute give a more preferred result in the operation of the process and in the properties of the product according to this invention.

With reference to the heated body used in the process of this invention, the radius of surface curvature of the heated body must be provided in the range of about 15–75 millimeters and, more preferably about 30–50 millimeters. The surface temperature of the heated body must be maintained in the range of about 170°–250°C and preferably about 170°–230°C. Further, much more preferably, it should be in the range of about 200°–220°C. The value of the surface temperature of the heated body must be measured when the filaments are not running. The actual temperature at the surface, where the running filaments contact the heater surface, will be lower than the above mentioned setting temperature of the heated body. The actual temperature at the surface where the running filaments contact the heater surface should be maintained below the melting point of the filaments, and below the softening point of the filaments where filaments having a lower dyeing speed are desired. In the case of filaments consisting of poly-epsilon-capramide, the melting point of the filaments is about 215°–220°C and their softening point is about 180°C.

The angle of contact of the filaments to the heated body should be adjusted in the range of from about 80° to about 160°.

The peripheral speed of the draw roll must be kept higher than about 800 meters per minute. A speed between 800 and 1600 meters per minute gives a more preferred result in the operation of the process and in the properties of the crimped filaments produced according to this invention. And the surface temperature of the draw roll should be maintained at less than about 220°C, preferably between about 55° and 220°C, and further most preferably between about 100° and 170°C.

As to the steam jet crimping in this invention, many kinds of steam jet structures conventionally used in the crimping of filaments, for example, disclosed in the hereinbefore described U.S. Patents in reference to steam jet crimping are applicable to the practice of this invention. The temperature of the steam introduced into the steam jet nozzle is selected in the range of about 200°–350°C, more preferably in the range of about 200° to 300°C. And it is preferred that the pressure of the steam should be maintained in the range of about 3–15 kilograms per square centimeter.

The filaments being fed to the steam jet have speeds higher than the speeds of the take-up of the filaments emerging from the steam jet, that is, the filaments are overfed into the steam jet. It is preferred that the overfeed ratio be selected between about 20 and 100 percent, much more preferably between about 30 and 60 percent.

After emerging from the steam jet, the crimped filaments are allowed to cool and are passed through a take-up roll.

BRIEF DESCRIPTION OF THE DRAWING

The accompanying drawing is a schematic representation of one form of process in accordance with the present invention.

DETAILED DESCRIPTION OF THE INVENTION

The process of the invention will be understood better from the following description, taken in connection with the accompanying drawing.

In the accompanying drawing, filaments 4 having non-circular cross sections are melt-spun from a spinneret 1 having non-circular cross section spinning holes, caused to cool with cooling air 2, pass in contact with a conventional spinning oiling agent applying roll 3. After converging for picking up the substantially non-aqueous oiling agent, they pass around feed rolls 5 having speeds greater than 200 meters per minute, through doubling pins 7 and 8 and are fed in a flat or ribbon-like filament arrangement to a heated body 6, and pass around in contact with the heated body 6 through a contact angle 8, which is between about 80° and about 160°. The surface temperature of the heated body 6 is maintained in the range of about 170° and 250°C and the radius of surface curvature R is in the range of about 15–75 millimeters to provide one-sided heating and drawing to the filaments. The filaments then pass around heated draw rolls 9 having a peripheral speed of more than about 800 meters per minute and a surface temperature of less than about 220°C, pass through a steam jet 10 which is supplied with steam at a temperature in the range of about 200°–350°C, are jetted out from the steam jet 10 and impinge upon a metallic screen 11 for steam jet crimping. In some cases the screen is not necessary. After the filaments leave the screen, they pass in contact with a tensioning guide 12, through first take up rolls 13, and are then introduced into an air jet 14 where the filaments are tangled or interlaced, and then further pass through second take up rolls 15, and then are wound up by a winder 16.

Both the latent crimps caused by one-sided heating and drawing are introduced into the filaments substantially simultaneously by passing the filaments in contact with the heated body 6. Direct crimp is introduced into the filaments, and also the latent crimp is brought out and imparted into the filament by passing through the steam jet 10 or passing through the combination of the steam jet 10 and the screen 11.

The following specific examples further illustrate embodiments of the invention. They are, however, not intended to be limitative.

EXAMPLES 1–3 AND COMPARATIVE EXAMPLES 1–3

Poly-epsilon-capramide flakes having a relative viscosity of 2.84 are melt-spun at a temperature of 280°C through a spinneret having a set of holes of non-circular cross section. The non-circular cross section spun filaments are allowed to cool, are treated with a substantially non-aqueous oiling agent, are passed around feed rolls, pin-textured and drawn with a heated body, heat-set with draw rolls, steam-jet-textured with a steam jet and wound up as shown in the accompanying drawing using the specific process conditions in Table I and Table II.

TABLE I

| Spinneret Type (X 1) | | Example 1 0.1/0.5(Y)-48H | Example 2 0.1/1.25(Y)-72H | Example 3 0.2/0.5(Y)-136H |
|---|---|---|---|---|
| Oiling agent | oil content | Oil A (2) | Oil A | Oil A |
| | water content (wt.%) | 0.1 | 0.1 | 0.1 |
| | Pick-up volume (wt.%) | 3.0 | 3.0 | 3.0 |
| Feed Roll | Peripheral speed (m/min.) | 329 | 375 | 238 |
| | surface finishing | aventurine | aventurine | aventurine |
| Heated body (heated pin) | set surface temperature (°C) | 210 | 210 | 220 |
| | radius of surface curvature (R)(mm) | 40 | 40 | 40 |
| | contact angle (θ) (degrees) | 120 | 120 | 120 |
| | surface finishing | aventurine | aventurine | aventurine |
| | Peripheral speed (m/min.) | 1250 | 1500 | 1000 |

TABLE I-continued

| Spinneret Type (X 1) | | Example 1 0.1/0.5(Y)-48H | Example 2 0.1/1.25(Y)-72H | Example 3 0.2/0.5(Y)-136H |
|---|---|---|---|---|
| Draw roll | set surface temperature (°C) | 150 | 160 | 130 |
| | surface finishing | aventurine | aventurine | aventurine |
| Draw ratio | | 3.8 | 4.0 | 4.2 |
| Steam jet | temperature of steam (°C) | 270 | 280 | 260 |
| | Pressure of steam (kg/cm²) | 9 | 9 | 9 |
| Overfeed ratio | | 45 | 30 | 50 |
| Properties of crimped filaments | denier of filaments | 840 | 1300 | 2600 |
| | modification ratio of cross section of filament | 3.0 | 5.0 | 2.2 |
| | crimp stretchability (%) (X 3) | 27.2 | 20.6 | 24.0 |
| | degree of crimp (crimps/inch) | 17 | 19 | 16 |
| Properties of carpet | | good | good | good |

TABLE II

| Spinneret Type (X 1) | | COMPARATIVE EXAMPLE 1 0.1/0.5(Y)-48H | COMPARATIVE EXAMPLE 2 0.1/0.5(Y)-48H | COMPARATIVE EXAMPLE 3 0.1/0.5(Y)-48H |
|---|---|---|---|---|
| Oiling Agent | oil content | Oil A (X 2) | Oil A | Oil A |
| | water content (wt. %) | 0.1 | 0.1 | 0.1 |
| | pick up volume (wt. %) | 3.0 | 3.0 | 3.0 |
| Feed Roll | Peripheral speed (m/min.) | 329 | 329 | 474 |
| | Surface finishing | aventurine | aventurine | aventurine |
| Heated body (heated pin) | set surface temperature (°C) | 210 | 160 | 210 |
| | radius of surface curvature (R) (mm) | 40 | 40 | 40 |
| | contact angle (θ) (degrees) | 120 | 120 | 120 |
| | surface finishing | aventurine | aventurine | aventurine |
| Draw roll | Peripheral speed (m/min) | 1250 | 1250 | 1800 |
| | set surface temperature (°C) | 60 | 150 | 150 |
| | surface finishing | aventurine | aventurine | aventurine |
| Draw ratio | | 3.8 | 3.8 | 3.8 |
| Steam jet | temperature of steam (°C) | 270 | 270 | 270 |
| | Pressure of steam (kg/cm²) | 9 | 9 | 9 |
| Overfeed ratio | | 20 | 18 | 17 |
| Properties of crimped filaments | denier of filaments | 840 | 840 | 840 |
| | modification ratio of cross section of filament | 3.0 | 3.0 | 3.0 |
| | crimp stretchability (%) (X 3) | 16.0 | 12.0 | 12.0 |
| | degree of crimp (crimps/inch) | | | |
| Properties of carpet | | fairly good | bad | fairly good |

NOTE:
X 1 The description of 0.1/0.5 (Y)-48 H means that the spinneret has 48 spinning holes, and that the cross section of each spinning hole has symmetrical Y shape and, further, that each slit in the shape has a width of 0.1 millimeter and a length of 0.5 millimeter, as same as hereinafter described.
X 2 Oil A consists of 20% of lauryl alcohol added to ethylene oxide and 80% of mineral oil.
X 3 The crimp stretchability is measured as follows:
The processed filaments are treated with boiling water.
The length ($l^1$) of the treated filaments is measured under a tension of 1 mg/denier and, further, the length ($l^2$) of the treated filaments is measured under a tension of 100 mg/denier. The crimp stretchability is calculated using the formula $(l^2 - l^1) \times 100/l$ based on the above values of $l^1$ and $l^2$.

EXAMPLES 4–14 AND COMPARATIVE EXAMPLES 4–22

Poly-epsilon-capramide flakes having relative viscosity of 2.84 are melt-spun at a temperature of 280° C through a spinneret having a set of 68 holes of Y-shape cross section. The Y-shape cross section spun filaments are allowed to cool, are treated with a substantially non-aqueous oil agent, are passed around feed rolls having aventurine surface finishing, pin-textured and drawn with a heated body having aventurine surface finishing, heat-set with draw rolls having aventurine surface finishing, steam-jet-textured with a steam jet and wound up as shown in the accompanying drawing using the specific process conditions in Table III. The finally wound up filaments has a total denier of about 1300.

TABLE III

| Example or Comparative Example No. (E: Example, C.E.: Comparative Example) | | E. 4 | C.E. 4 | C.E. 5 | C.E. 6 | C.E. 7 | E. 5 |
|---|---|---|---|---|---|---|---|
| Oiling agent | Water content of Oil A (%) | 0.1 | 0.1 | 0.1 | 10.0 | 6.0 | 2.0 |
| | pick-up volume | 3.0 | 3.0 | 3.0 | 3.0 | 3.0 | 3.0 |
| Feed Roll | Peripheral speed (m/min.) | 375 | 375 | 375 | 375 | 375 | 375 |
| Modification ratio of filament being introduced to heated body | | 3.0 | 1.0 | 6.0 | 3.0 | 3.0 | 3.0 |
| Heated body (heated pin) | Set Surface temperature (°C) | 210 | 210 | 210 | 210 | 210 | 210 |
| | Radius of Surface Curvature (R)(mm) | 40 | 40 | 40 | 40 | 40 | 40 |
| | Contact angle (θ) (degrees) | 120 | 120 | 120 | 120 | 120 | 120 |
| Draw Roll | Peripheral speed (m/min.) | 1500 | 1500 | 1500 | 1500 | 1500 | 1500 |
| | Set Surface temperature | 160 | 160 | 160 | 160 | 160 | 160 |
| Steam Jet | Temperature of Steam (°C) | 260 | 260 | 260 | 260 | 260 | 260 |
| | Pressure of Steam (kg/cm) | 9.0 | 9.0 | 9.0 | 9.0 | 9.0 | 9.0 |
| Over feed ratio | | 40 | 40 | 40 | — | — | 30 |
| State of Continuous Processing | | good | good | good | bad | bad | fairly good |
| Properties of | Crimp stretchability (%) | 25.0 | 12.4 | 14.8 | — | — | 23.0 |

TABLE III-continued

| | | | | | | | |
|---|---|---|---|---|---|---|---|
| Crimped Filaments | State of filament slack | few | few | few | — | — | a few |
| | State of crimp property | good | bad | bad | — | — | fairly good |

| Example or Comparative Example No. (E: Example, C.E.: Comparative Example) | | C.E. 8 | C.E. 9 | C.E. 10 | C.E. 11 | E. 6 | C.E. 12 |
|---|---|---|---|---|---|---|---|
| Oiling agent | Water content of Oil A (%) | 0.1 | 0.1 | 0.1 | 0.1 | 0.1 | 0.1 |
| | Pick-up volume | 3.0 | 3.0 | 3.0 | 3.0 | 3.0 | 3.0 |
| Feed Roll | Peripheral speed (m/min) | 150 | 250 | 375 | 375 | 375 | 375 |
| Modification ratio of filament being introduced to heated body | | 3.0 | 3.0 | 3.0 | 3.0 | 3.0 | 3.0 |
| Heated body (heated pin) | Set Surface temperature (°C) | R.T. (X 5) | R.T. | R.T. | 140 | 180 | 240 |
| | Radius of Surface Curvature (R)(mm) | 40 | 40 | 40 | 40 | 40 | 40 |
| | Contact Angle (θ) (degrees) | 120 | 120 | 120 | 120 | 120 | 120 |
| Draw Roll | Peripheral Speed (m/min.) | 600 | 1000 | 1500 | 1500 | 1500 | 1500 |
| | Set Surface Temperature | 160 | 160 | 160 | 160 | 160 | 160 |
| Steam Jet | Temperature of Steam (°C) | 220 | 220 | 260 | 260 | 260 | 260 |
| | Pressure of Steam (kg/cm) | 9.0 | 9.0 | 9.0 | 9.0 | 9.0 | 9.0 |
| Over feed ratio | | 110 | 90 | 40 | 30 | 40 | 40 |
| State of continuous processing | | good | good | good | good | good | fairly good |
| Properties of Crimped Filaments | Crimp stretchability (%) | 28.0 | 18.0 | 10.8 | 11.2 | 17.7 | 32.2 |
| | State of filament slack | few | many | many | few | few | many |
| | State of Crimp property | good | fairly good | bad | bad | fairly good | fairly good |

| Example or Comparative Example No. (E: Example, C.E.: Comparative Example) | | C.E. 13 | C.E. 14 | E. 7 | E. 8 | C.E. 15 | E. 9 |
|---|---|---|---|---|---|---|---|
| Oiling agent | Water content of Oil A (%) | 0.1 | 0.1 | 0.1 | 0.1 | 0.1 | 0.1 |
| | Pick-up volume | 3.0 | 3.0 | 3.0 | 3.0 | 3.0 | 3.0 |
| Feed Roll | Peripheral Speed (m/min.) | 375 | 375 | 375 | 450 | 375 | 375 |
| Modification ratio of filament being introduced to heated body | | 3.0 | 3.0 | 3.0 | 3.0 | 3.0 | 3.0 |
| Heted body (heated pin) | Set Surface Temperature (°C) | 260 | 300 | 200 | 220 | 210 | 210 |
| | Radius of Surface Curvature (R)(mm) | 40 | 40 | 40 | 40 | 40 | 40 |
| | Contact Angle (θ) (degrees) | 120 | 120 | 120 | 120 | 120 | 120 |
| Draw Roll | Peripheral Speed (m/min.) | 1500 | 1500 | 1000 | 1800 | 1500 | 1500 |
| | Set Surface Temperature | 160 | 160 | 160 | 160 | R.T. | 90 |
| Steam Jet | Temperature of Steam (°C) | 260 | 260 | 260 | 260 | 260 | 260 |
| | Pressure of Steam (kg/cm) | 9.0 | 9.0 | 9.0 | 9.0 | 9.0 | 9.0 |
| Over feed ratio | | — | — | 40 | 40 | 40 | 40 |
| State of continuous processing | | bad | bad | good | good | good | good |
| Properties of Crimped Filaments | Crimp stretchability (%) | — | — | 28.7 | 22.4 | 0.2 | 17.3 |
| | State of filament slack | — | — | few | few | few | few |
| | State of crimp property | — | — | good | fairly good | bad | fairly good |

| Example or Comparative Example No. (E: Example, C.E.: Comparative Example) | | E. 10 | C.E. 16 | E. 11 | E. 12 | C.E. 17 | E. 13 |
|---|---|---|---|---|---|---|---|
| Oiling agent | Water content of Oil A (%) | 0.1 | 0.1 | 0.1 | 0.1 | 0.1 | 0.1 |
| | Pick-up volume | 3.0 | 3.0 | 3.0 | 3.0 | 3.0 | 3.0 |
| Feed Roll | Peripheral Speed (m/min.) | 375 | 375 | 375 | 375 | 375 | 375 |
| Modification ratio of filament being introduced to heated body | | 3.0 | 3.0 | 3.0 | 3.0 | 3.0 | 3.0 |
| Heated body (heated pin) | Set surface temperature (°C) | 210 | 210 | 210 | 210 | 210 | 210 |
| | Radius of Surface curvature (R)(mm) | 40 | 40 | 40 | 40 | 40 | 40 |
| | Contact angle (θ) (degrees) | 120 | 120 | 120 | 120 | 120 | 120 |
| Draw Roll | Peripheral speed (m/min.) | 1500 | 1500 | 1500 | 1500 | 1500 | 1500 |
| | Set surface temperature | 190 | 230 | 160 | 160 | 160 | 160 |
| Steam Jet | Temperature of steam (°C) | 260 | 260 | 220 | 300 | 360 | 260 |
| | Pressure of steam (kg/cm) | 9.0 | 9.0 | 9.0 | 9.0 | 9.0 | 6.0 |
| Over feed ratio | | 40 | — | 40 | 40 | — | 40 |
| State of continuous processing | | good | bad | good | fairly good | bad | good |
| Properties of crimped filaments | Crimp stretchability (%) | 21.5 | — | 18.5 | 21.6 | — | 23.0 |
| | State of filament slack | a few | — | few | a few | — | few |
| | State of crimp property | fairly good | — | fairly good | fairly good | — | good |

| Example or Comparative Example No. (E: Example, C.E.: Comparative Example) | | E. 14 | C.E. 18 | C.E. 19 | C.E. 20 | C.E. 21 | C.E. 22 |
|---|---|---|---|---|---|---|---|
| Oiling agent | Water content of Oil A (%) | 0.1 | 0.1 | 0.1 | 0.1 | 0.1 | 0.1 |
| | Pick-up volume | 3.0 | 3.0 | 3.0 | 3.0 | 3.0 | 3.0 |
| Feed roll | Peripheral speed (m/min.) | 329 | 375 | 375 | 375 | 375 | 394 |
| Modification ratio of filament being introduced to heated body | | 3.0 | 3.0 | 3.0 | 3.0 | 1.0 | 1.8 |
| Heated body (heated pin) | Set surface temperature (°C) | 210 | 180 | 210 | 210 | 210 | 210 |
| | Radius of Surface curvature (R)(mm) | 40 | 40 | 40 | 40 | 40 | 40 |
| | Contact angle (θ) (degrees) | 120 | 120 | 120 | 120 | 120 | 120 |
| Draw Roll | Peripheral speed (m/min.) | 1250 | 1500 | 1500 | 1500 | 1500 | 1500 |
| | Set surface temperature | 160 | 160 | 90 | 90 | 90 | 90 |
| Steam Jet | Temperature of steam (°C) | 260 | 180 | 190 | X 6 | X 6 | X 6 |
| | Pressure of steam (kg/cm) | 9.0 | 9.0 | 9.0 | | | |
| Over feed ratio | | 40 | 40 | 40 | — | — | — |
| State of continuous processing | | good | good | good | good | good | good |
| properties of Crimped | Crimp stretchability (%) | 27.2 | 9.6 | 11.7 | 26.2 | 1.5 | 40.0 |
| | State of filament slack | few | few | few | few | few | few |

TABLE III-continued

| Filaments | State of crimp property | good | bad | bad | good | bad | good |
|---|---|---|---|---|---|---|---|

NOTE:
X 5 R.T. means room temperature, as same as hereinafter described.
NOTE:
X 6 In the last three comparative examples, the drawn filaments are wound up after passing through the draw roll, and in a separate process the filaments rewound are passed in speed of 200 m/min. through a steam box which is supplied with saturated steam.

We claim:

1. A process for the manufacture of a crimped polyamide filament yarn in which spinning, drawing and crimping are performed continuously, said process comprising:
   a. melt-spinning a polyamide into a plurality of undrawn filaments through a spinneret having non-circular cross section spinning holes,
   b. cooling the filaments,
   c. applying to the filaments an oiling agent having a water content in the range of 0–5 weight percent,
   d. passing the filaments around a feed roll having a peripheral speed in the range of about 200–400 meters per minute,
   e. passing the filaments in contact with a heated body using a contact angle between about 80° and about 160° on which body the surface temperature is maintained in the range of about 170°–250°C and the radius of surface curvature is in the range of about 15–75 millimeters for imparting one-sided heating to cause a latent crimp, and drawing to the filaments,
   f. passing the filaments around a draw roll having a peripheral speed in the range of about 800–1600 meters per minute and a surface temperature of less than about 220°C,
   g. passing the filaments through a steam jet which is supplied with steam at a temperature in the range of about 200°–350°C, and about 3–15 kilograms per square centimeter gage pressure, with about 20–100% overfeed of said filaments to said steam jet, whereby a direct crimp is introduced into the filaments and the latent crimp in the filaments is brought out, and
   h. winding up the filaments.

2. A process according to claim 1 wherein each said non-circular cross section filament introduced to said heated body has a modification ratio of between about 1.5 and about 5.0.

3. A process according to claim 2 wherein the modification ratio is between about 2.0 and about 3.0.

4. A process according to claim 3 wherein the cross section of the filament has a symmetrical Y shape.

5. A process according to claim 1 wherein the oiling agent has a water content in the range of about 0–1.5 weight percent.

6. A process according to claim 1 wherein a denier of each single filament introduced into the heated body is in the range of from about 25 to about 120.

7. A process according to claim 1 wherein the radius of surface curvature of the heated body is in the range of about 30–50 millimeters.

8. A process according to claim 1 wherein the surface temperature of the heated body is maintained in the range of about 170°–230°C.

9. A process according to claim 8 wherein the temperature is selected in the range of about 200°–220°C.

10. A process according to claim 1 wherein the surface temperature of the drawn roll is maintained between about 55° and 220°C.

11. A process according to claim 10 wherein the surface temperature of the draw roll is between about 100° and 170°C.

12. A process according to claim 11 wherein the steam temperature is in the range of about 200° to 300°C.

13. A process according to claim 1 wherein the overfeed ratio between about 30 and about 60 percent.

14. A process according to claim 1 wherein the filaments emerging from the steam jet are jetted onto a screen.

15. A process according to claim 1 wherein both the feed roll and the draw roll have aventurine surface finishing.

16. A process according to claim 1 wherein the polyamide is poly-epsilon-capramide having a relative viscosity of between about 2.0 and about 3.0.

17. A process according to claim 1 wherein the volume of the oiling agent picked up on the filaments is not less than about 1.0 weight percent of the filaments.

18. A process according to claim 17 wherein said volume is not less than about 3.0 weight percent of the filaments.

19. A process according to claim 1 wherein after steam jet treatment, the filaments are passed through a tensioning guide, through a first take up roll, are interlaced with an air jet, pass through a second take up roll and subsequently are wound up without application of twist.

20. A process for the manufacture of a crimped poly-epsilon-capramide filament yarn in which spinning, drawing and crimping are performed continuously, said process comprising:
   a. melt-spinning a poly-epsilon-capramide having a relative viscosity of between about 2.0 and about 3.0 into a plurality of undrawn filaments having non-circular cross sections at a spinning temperature of between about 240° and about 290°C,
   b. cooling the filaments,
   c. applying an oiling agent having a water content in the range of about 0–5 weight percent, at a pickup volume not less than about 1.0 weight percent of the filaments,
   d. passing the filaments around a feed roll having a peripheral speed of about 200 and 400 meters per minute and an aventurine surface finishing,
   e. passing the filaments consisting of a plurality of single filament having a denier in the range of about 25 to about 120 in contact with a heated body at a contact angle between about 80° and about 160° , on which the surface temperature is maintained in the range of about 170°–230°C and the radius of surface curvature is in the range of about 15–75 millimeters for imparting one-sided heating to cause a latent crimp and drawing to the filaments,
   f. passing the filaments around a draw roll having a peripheral speed of between about 800 and 1600 meters per minute, and a surface temperature of between about 55° and 220°C and further an aventurine surface finishing,
   g. passing the filaments through a steam jet which is supplied with steam at a temperature in the range of about 200°–350°C, and
   h. winding up the filaments.

* * * * *